US007055734B2

(12) United States Patent
Provus et al.

(10) Patent No.: US 7,055,734 B2
(45) Date of Patent: Jun. 6, 2006

(54) COLLAPSIBLE CARTON

(75) Inventors: Wayne B. Provus, Highland Park, IL (US); Edward Lynn Mitchusson, Memphis, TN (US)

(73) Assignee: The Royal Group, Cicero, IL (US)

( * ) Notice: Subject to any disclaimer, the term of this patent is extended or adjusted under 35 U.S.C. 154(b) by 0 days.

(21) Appl. No.: 10/930,625

(22) Filed: Aug. 31, 2004

(65) Prior Publication Data

US 2006/0043161 A1 Mar. 2, 2006

(51) Int. Cl.
*B65D 5/06* (2006.01)

(52) U.S. Cl. ..... 229/141; 229/136; 229/154

(58) Field of Classification Search ..... 229/132, 229/136, 141, 143, 154
See application file for complete search history.

(56) References Cited

U.S. PATENT DOCUMENTS

| | | | | |
|---|---|---|---|---|
| 1,223,232 | A * | 4/1917 | Ash | 229/154 |
| 2,967,655 | A * | 1/1961 | Seger, Jr. | 229/109 |
| 3,040,960 | A * | 6/1962 | Younger | 229/132 |
| 3,140,809 | A * | 7/1964 | Hickin et al. | 229/132 |
| 4,291,828 | A | 9/1981 | Nigro | |
| 4,605,128 | A * | 8/1986 | Rieke | 229/242 |
| 4,848,589 | A * | 7/1989 | Olson et al. | 229/136 |
| 6,059,178 | A * | 5/2000 | Malloy et al. | 229/136 |
| 6,135,347 | A * | 10/2000 | Mueller | 229/183 |

FOREIGN PATENT DOCUMENTS

| | | | | |
|---|---|---|---|---|
| FR | 2599334 | A1 * | 12/1987 | 229/141 |

* cited by examiner

*Primary Examiner*—Gary E. Elkins
(74) *Attorney, Agent, or Firm*—Wood, Phillips, Katz, Clark & Mortimer

(57) ABSTRACT

A folding carton formed from a blank of corrugated board, including first, second, third and fourth side walls hingedly connected by their edges to form a generally rectangular tubular enclosure, a bottom formed by at least two bottom walls hingedly connected to at least two of the side walls, and a top wall. The top wall is formed by first through fourth top cover flap hingedly connected at one edge to the first through fourth side wall respectively. Each of the top cover flaps is generally rectangular with the second top cover flap including ears extending from corners at the edge opposite the one edge and the first and third top cover flaps each including a notch corresponding to one of the ears. An adhesive is on one surface of the second top cover flap adjacent the opposite edge.

18 Claims, 2 Drawing Sheets

COLLAPSIBLE CARTON

CROSS REFERENCE TO RELATED APPLICATION(S)

Not applicable.

Statment Regarding Federally Sponsored Research or Development

Not applicable.

Reference to a Microfiche Appendix

Not applicable.

TECHNICAL FIELD

The present invention is directed toward cartons, and particularly toward collapsible cartons formed from a blank of corrugated board.

BACKGROUND OF THE INVENTION AND TECHNICAL PROBLEMS POSED BY THE PRIOR ART

Cartons, boxes and containers formed from blanks of corrugated cardboard are widely used in the world for storing and for shipping materials. U.S. Pat. No. 4,291,828, for example, illustrates one carton configuration which has been used, such configuration being particularly well suited for uses in which it is desirable that the carton be capable of being automatically set up with minimal manual effort.

Given the widespread use of such cartons by disparate people, from professionals who ship large amounts of products each day to grandmothers packing a few precious heirlooms for storage, it is important that such cartons not only be easy and quick to assemble and easy to use, but also be reliable for shipping and/or storing many different objects for many different purposes.

In most uses, particularly shipping, it is important that the cartons be reliably maintained in a secure closed configuration, thereby not only protecting the contents inside the carton but also ensuring that the contents remain in the carton even if it is moved around. To accomplish this, a wide variety of techniques have been used to close the container top, including crisscrossing the top flaps of the container, taping the top flaps, and adhering the container flaps in a closed configuration through the use of adhesive applied to at least one of the flaps.

Moreover, particularly because such containers are usually secondary to the item being stored or shipped (i.e., the people using the cartons view them as a necessary material which is apart from the more valuable item placed in the carton, with such item being of primary interest), it is important that the carton not only meet the ease of use and reliability requirements, but that it meet such requirements at minimum cost. Therefore, it is desirable to form such cartons of inexpensive materials which may be easily processed with minimal waste of material.

Further, it is desirable that the cartons be able to be compactly configured when not in use to minimize the cost of shipping and storage of the cartons themselves. To accomplish this, cartons are typically formed from blanks of suitable materials such as corrugated board and are provided in a collapsed condition to the end user. Of course, given the diversity of end users, this only heightens the need for a structure which may be easily changed to a container configuration from the flat configuration.

The present invention is directed toward overcoming one or more of the problems set forth above.

SUMMARY OF THE INVENTION

In one aspect of the present invention, a corrugated container formed from a blank is provided, including first, second, third and fourth side walls hingedly connected by their edges to form a generally rectangular tubular enclosure, a bottom wall for the enclosure between lower edges of the side walls; and a top wall. The top wall is formed by a first top cover flap hingedly connected at one edge to the first side wall, a second top cover flap hingedly connected at one edge to the second side wall, a third top cover flap hingedly connected at one edge to the third side wall, and a fourth top cover flap hingedly connected at one edge to the fourth side wall. Each of the top cover flaps is generally rectangular with the second top cover flap including ears extending from corners at the edge opposite the one edge and the first and third top cover flaps each including a notch corresponding to one of the ears.

In one form of this aspect of the present invention, the top cover flaps have a spacing S between the hinged one edge and the opposite edge, with spacing S being greater than half of the width of the first and third side walls by an amount generally equal to half of the spacing between edges of the ears.

In another form of this aspect of the present invention, the second top cover flap is a generally rectangular section and the ears extend from opposite sides of the rectangular section, with the ears hingedly connected to the rectangular section.

In still another form of this aspect of the present invention, adhesive is provided on one surface of the ears. In a further form, the adhesive is a continuous strip of adhesive on the ears and adjacent the opposite edge of the second top cover flap between the ears whereby the second cover top flap is securable by the adhesive to the fourth cover top flap with the ears securable by the adhesive to the first and third side walls. In a still further form, a liner is on the adhesive, where the liner is selectively removable to expose the adhesive for securing the ears to the first and third side walls.

In yet another form of this aspect of the present invention, the top cover flaps have a spacing between the hinged one edge and the opposite edge which is greater than half of the width of the first and third side walls.

In still another form of this aspect of the invention, the blank is cut with a perforated connection between the ears and the first and third top cover flaps. In a further form, punched out holes are between the ears and the first and third top cover flaps.

In another aspect of the present invention, a folding carton formed from a blank of cardboard is provided, including first, second, third and fourth side walls hingedly connected by their edges to form a generally rectangular tubular enclosure, a bottom formed by at least two bottom walls hingedly connected to at least two of the side walls, and a top wall. The top wall is formed by a first top cover flap hingedly connected at one edge to the first side wall, a second top cover flap hingedly connected at one edge to the second side wall, a third top cover flap hingedly connected at one edge to the third side wall, and a fourth top cover flap hingedly connected at one edge to the fourth side wall. The second top cover flap edge opposite the second top cover flap one edge has a width greater than the second side wall, and an adhesive is on one surface of the second top cover flap adjacent the opposite edge.

In one form of this aspect of the invention, a liner is on the adhesive and is selectively removable to expose the adhesive for securing the second top cover flap to the first and third side walls.

In another form of this aspect of the invention, the second top cover flap has ears extending from opposite sides of the second cover flap defining the greater width. In a further form, the top cover flaps have a spacing between the hinged one edge and the opposite edge which is greater than half of the width of the first and third side walls. In a further form, the top cover flaps have a spacing S between the hinged one edge and the opposite edge, with the spacing S being greater than half of the width of the first and third side walls by an amount generally equal to half of the spacing between edges of the ears. In a still further form, the second top cover flap includes a generally rectangular portion and the ears extend from opposite sides of the rectangular portion, and the ears are hingedly connected to the rectangular portion. In still another further form, the adhesive is on one surface of the ears, and in a still further form, the adhesive is a continuous strip of adhesive on the ears and adjacent the opposite edge of the second top cover flap between the ears.

In still another form of this aspect of the invention, the blank is cut with a perforated connection between the ears and the first and third top cover flaps and, in a still further form, punched out holes are between the ears and the first and third top cover flaps.

DETAILED DESCRIPTION OF THE INVENTION

Figure 1:
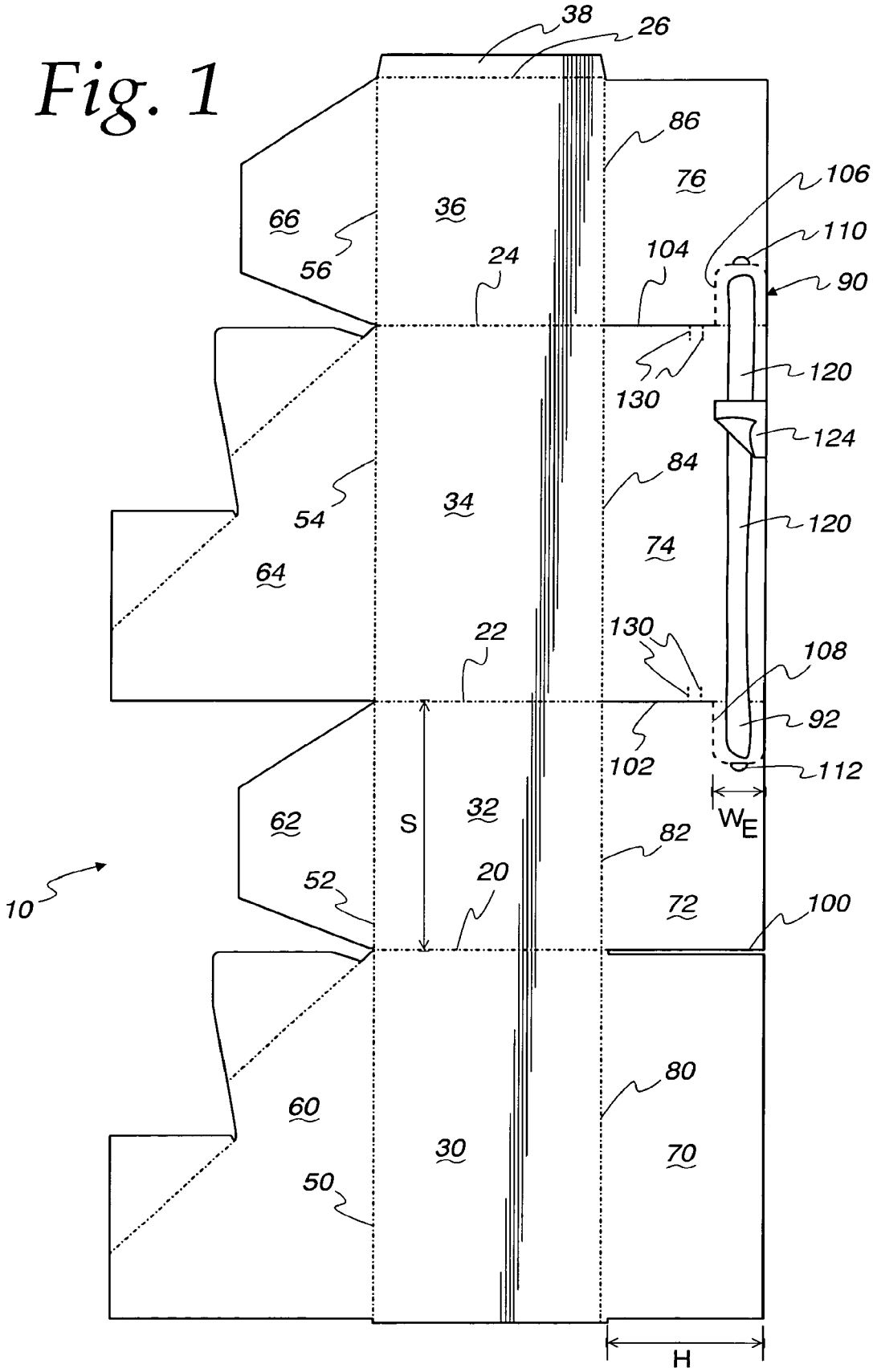
FIG. 1 is a plan view of a blank cut to form a carton according to the present invention.
Figure 2:
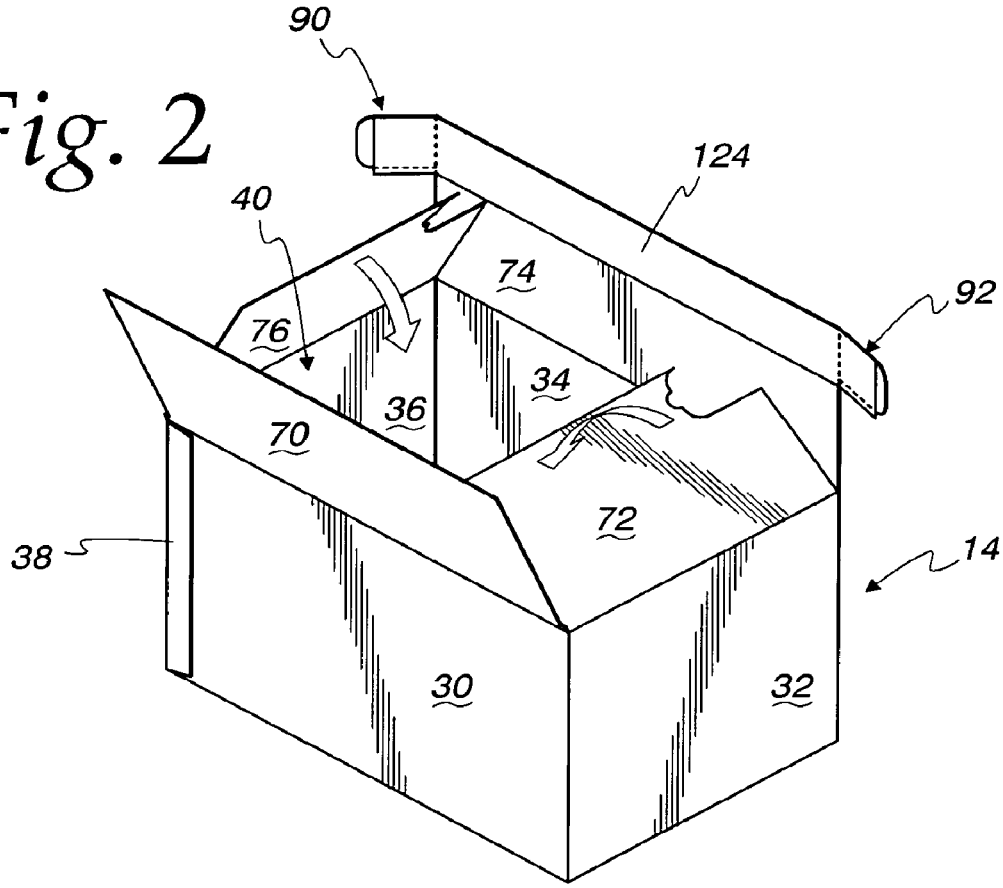
FIG. 2 is a perspective view of an open-topped carton formed from the FIG. 1 blank.
Figure 3:
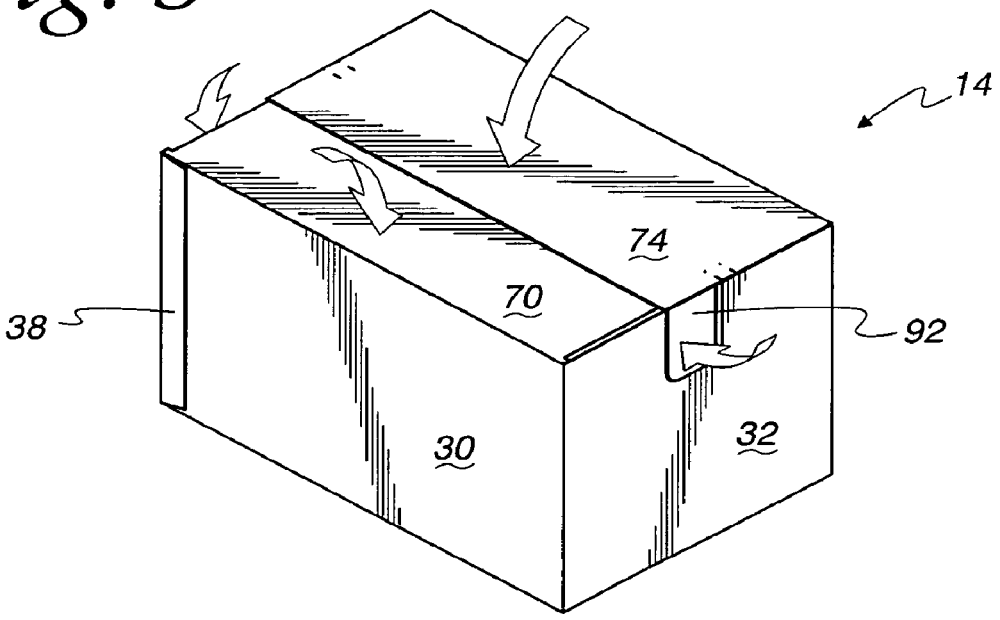
FIG. 3 is a perspective view of the FIG. 2 carton, with the carton top closed.

FIG. 1 illustrates a blank 10 cut to form a carton 14 according to the present invention as illustrated in FIGS. 2–3. The blank 10 may be produced from corrugated board or the like of any suitable size and weight (depending on the size and strength required of the carton 14 being produced) and is cut in the shape and form shown in FIG. 1. It is scored along various lines as described hereafter to define the several walls and flaps of the carton and to facilitate the bending of the blank 10 to produce the finished product.

It should be appreciated that the blank 10 is cut from a generally rectangular area of material, with the blank 10 being shaped so as to minimize cut off scraps/waste. This configuration also enables multiple blanks 10 to be cut from large pieces of material with minimal wasted material between the adjacent blanks 10. Moreover, it should be appreciated that the top of the blank 10 (which is the novel area of this invention) is substantially rectangular, thereby effectively resulting in a minimum of wasted material at that area.

The main portion of the blank 10 is of generally rectangular shape and is provided with a plurality of transverse score lines designated by numerals 20, 22, 24, and 26, thus outlining the main portions of the carton 14 which consist of the side walls 30, 32, 34, 36. For convenience herein, those walls may be referred to as a front wall 30, a rear wall 34 and two lateral walls 32, 36. The side walls 30, 32, 34, 36 define the sides of the enclosure produced by carton 14 formed from the blank 10.

At one edge of the lateral wall 36 is a narrow flap 38 which is suitably secured to the end of the front wall 30 (at the opposite end of the blank 10) whereby the enclosure of the carton 14 is defined on the sides by four side walls 30, 32, 34, 36. In the illustrated embodiment, the enclosure is rectangular, with the front and rear walls 30, 34 wider than the lateral walls 32, 36. (As used herein, the carton wall hingedly secured to the top flap which is outermost when closed [as described below] is referred to as the rear wall 34.) It should be appreciated that different dimensions could be used depending upon the size of carton desired. It is advantageous with the present invention that the lateral walls 32, 36 be narrower than, or at least not be significantly wider than, the front and rear walls 30, 34, although configurations in which the lateral walls are significantly wider than the front and rear walls may still use the broad scope of the present invention.

In completing the carton, the flap 38 is bent on score line 26 and is caused to contact the face of the front wall 30, and secured thereto by suitable means such as glue, paste, staples, fasteners or the like. (As illustrated in FIGS. 2–3, the flap 38 is secured to the outer face of the front wall 30, although it should be understood that it could also advantageously be secured to the inner face of the front wall 30). Thus, a rectangular tubular enclosure 40 is formed which is capable of being opened to the position shown in FIGS. 2–3, and may also be collapsed in a substantially flat condition. In the flat condition, the faces of the side walls 30, 32, 34, 36 (which form the interior of the container when opened) are disposed with the front wall 30 and lateral wall 32 in one plane which is substantially parallel to and in contact with rear wall 34 and the other lateral wall 36 which are likewise in the same plane. The two sets of walls are connected by hinge connections provided at the bending points of the carton along score lines 22 and 26.

Score lines 50, 52, 54, 56 along the bottom edges of the side walls 30, 32, 34, 36 hingedly connect bottom flaps 60, 62, 64, 66 which are used to form the bottom of the carton 14. The bottom flaps 60, 62, 64, 66 as illustrated are known, having been disclosed in U.S. Pat. No. 4,291,828, the disclosure of which is fully incorporated herein by reference. These flaps 60, 62, 64, 66 may be suitably connected as illustrated in the '828 patent to allow for the carton to be changed between the open and flat conditions with the bottom flaps 60, 62, 64, 66 cooperating to substantially automatically change between a flattened position and a position defining the bottom of the carton 14. It should be understood, however, that virtually any structure suitable for forming the bottom of the carton 14 could be used within the broad scope of the invention, with the illustrated flaps 60, 62, 64, 66 being merely one suitable example, and therefore further explanation of those flaps 60, 62, 64, 66 is not included herein.

In accordance with the present invention, the top wall of the carton 14 is formed by top cover flaps 70, 72, 74, 76, each of which are hingedly connected along score lines 80, 82, 84, 86 to side walls 30, 32, 34, 36, respectively. Each of the top cover flaps 70, 72, 74, 76 are generally rectangular in shape. However, the rear top cover flap 74 includes a pair of parallel ears 90, 92 at its corners opposite its score line 84 connection to the rear wall 34, with the ears 90, 92 being cut from corners of the adjacent lateral top cover flaps 72, 76.

It should be appreciated that a strip along the top of the rear cover flap 74 (at the location of the ears 90, 92) may be suitably reinforced if desired to strengthen the overall carton 14 via the configuration of the top wall as described below.

It should also be appreciated that the location of the ears 90, 92, in addition to providing the advantages further discussed below, may be accomplished with only minimal removal of materials from the lateral cover flaps 72, 76 and, moreover, that material is removed from a location where it is least needed. That is, it should be appreciated that when the carton 14 is opened to act as a container and the top flaps 70, 72, 74, 76 are closed as discussed below, the missing material from the lateral cover flaps 72, 76 will be beneath the center portion of the rear cover flap 74, where virtually no strength is provided by the lateral cover flaps 72, 76.

The top cover flaps 70, 72, 74, 76 are separated from one another by cuts 100, 102, 104. However, a perforated cut 106, 108 may be advantageously provided to releasably connected the ears 90, 92 to the lateral top cover flaps 72, 76. As a result, when the carton 14 is in a flat condition, the ear 90 at the bend corresponding to score line 22 between sides 32, 34 will bend with the lateral top cover flap 72 and thereby will not project out in a position in which it would be susceptible to damage. Punched out holes 110, 112 may be provided at the perforated connection of the ears 90, 92 to facilitate breaking of the perforated cut when the carton 14 is opened to function as a container.

A contact adhesive 120 may be suitably applied along the upper edge of one side of the front top cover flap 74. A suitable protective strip 124 (only partially shown in FIG. 1) may be applied over the adhesive 120. The protective strip 124 may be a suitable material, such as a silicon treated paper, which will adhere to the adhesive 120 but may be peeled therefrom to expose the adhesive 120 when desired as described below.

FIGS. 2 and 3 show the carton 14 in an open configuration and illustrate the advantageous closing of the carton 14 according to the present invention, in which the top wall of the carton 14 is formed by folding in the top cover flaps 70, 72, 74, 76. More specifically, the lateral top cover flaps 72, 76 are folded in first, followed by the front cover flap 70. After removal of the protective strip 124 from the adhesive 120, the rear cover flap 74 may be folded in so that the rectangular portion will overlie a portion of the front cover flap 70 and be secured thereto by the adhesive 120. Further, the ears 90, 92 will be bent down along the sides of the carton 14 and be secured to the lateral walls 32, 36 by the adhesive 120. The ears 90, 92 thus provide the particular advantage of providing an adhesion between surfaces which is perpendicular to the front and rear cover flap connection, which adhesion is extremely strong given that the extended length of the adhered surfaces is parallel to the direction of a normal opening force applied to the rear cover flap 74. Simply put, opening the carton 14 while the ears 90, 92 are adhered to the lateral walls 30, 34 will require not only a force sufficient to separate the adhesion between the front and rear cover flaps 70, 74 but also will require a force sufficient to shear the adhesive along the length of the connection between the ears 90, 92.

Perforations 130 may also be advantageously provided in the top cover flap 76 adjacent the ears 90, 92 to define a tear off strip (which may advantageously be suitably reinforced such as is known) to allow for the carton 14 to be opened when closed by tearing through the top cover flap 76 along a line between the perforations 130 adjacent to, but spaced from, the ears 90, 92.

It should also be appreciated that the height H of the top cover flaps 70, 72, 74, 76 (particularly the front and rear top cover flaps 70, 72) may advantageously be sized so that:

$H=0.5(S+W_E)$, where, as illustrated in FIG. 1:

S=the spacing between the sides of the lateral walls 32, 36 (i.e., the width of the lateral walls), and $W_E$=the width of the ears 90, 92.

Such a size ensures that the rear cover flap 74 will overlap the front cover flap 70 by substantially the width of the ears 90, 92 whereby, when the top cover flaps are closed, a portion of the front cover flap 70 having the width of the ears 90, 92 will both be physically trapped beneath the rear cover flap 74 and also adhered thereto by the width of the adhesive 120 on the rear cover flap 74 between the ears 90, 92. Moreover, the sides of the front cover flap 70 will be trapped between the ears 90, 92, thereby protecting against the carton 14 potentially twisting out of its rectangular shape.

From the foregoing disclosure, it should be evident that the novel carton 14 as described herein may be assembled in a minimum time, thereby substantially reducing the cost of assembly and storage. Moreover, the assembly may be accomplished simply and easily, with the use of the top cover flaps 70, 72, 74, 76 being virtually self evident to even the most inexperienced user.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A corrugated container formed from a blank, comprising:

first, second, third and fourth side walls hingedly connected by their edges to form a generally rectangular tubular enclosure;

a bottom wall for said enclosure between lower edges of the side walls; and a top wall formed by a first top cover flap hingedly connected at one edge to the first side wall, a second top cover flap hingedly connected at one edge to the second side wall, a third top cover flap hingedly connected at one edge to the third side wall, a fourth top cover flap hingedly connected at one edge to the fourth side wall, wherein each of said top cover flaps is generally rectangular with said second top cover flap including ears extending from corners at the edge opposite the one edge and said first and third top cover flaps each including a notch corresponding to one of the ears, said second and fourth top cover flaps have a spacing between their hinged one edge and their opposite edge, wherein said spacing is greater than half of the width of the first and third side walls by an amount generally equal to half of the spacing between edges of the ears, and said spacing between edges of the ears is substantially less than half of said spacing between said hinged one edge and opposite edge of said second top cover flap.

2. The corrugated container of claim 1, wherein said second top cover flap comprises a generally rectangular section and said ears extend from opposite sides of said rectangular section, and said ears are hingedly connected to said rectangular section.

3. The corrugated container of claim 1, further comprising adhesive on one surface of said ears.

4. The corrugated container of claim 3, wherein said adhesive comprises a continuous strip of adhesive on said ears and adjacent said opposite edge of said second top cover flap between said ears whereby said second cover top flap is securable by said adhesive to said fourth cover top flap with said ears securable by said adhesive to said first and third side walls.

5. The corrugated container of claim 3, further comprising a liner on said adhesive, said liner being selectively removable to expose said adhesive for securing said ears to said first and third side walls.

6. The corrugated container of claim 1, wherein said top cover flaps have a spacing between said hinged one edge and the opposite edge which is greater than half of the width of the first and third side walls.

7. The corrugated container of claim 1, wherein said blank is cut with a perforated connection between said ears and said first and third top cover flaps.

8. The corrugated container of claim 7, further comprising punched out holes between said ears and said first and third top cover flaps.

9. The corrugated container of claim 1, further comprising a tear off strip in said second top cover flap spaced from and parallel to said second top cover flap one edge and adjacent to but spaced from said ears.

10. A folding carton formed from a blank of cardboard, comprising:

first, second, third and fourth side walls hingedly connected by their edges to form a generally rectangular tubular enclosure;

a bottom formed by at least two bottom walls hingedly connected to at least two of said side walls; and a top wall formed by a first top cover flap hingedly connected at one edge to the first side wall, a second top cover flap hingedly connected at one edge to the second side wall, a third top cover flap hingedly connected at one edge to the third side wall, a fourth top cover flap hingedly connected at one edge to the fourth side wall, wherein the second top cover flap edge opposite said second top cover flap one edge has a width greater than said second side wall, the portion of said second top cover flap having a greater width than said second side wall has a width $W_E$ in the direction between said second top cover flap one edge and said second top cover flap opposite edge, said second and fourth top cover flaps have a spacing between their hinged one edge and their opposite edge which is greater than half of the width of the first and third side walls by an amount substantially equal to half of $W_E$, and $W_E$ is substantially less than half of said spacing S; and an adhesive on one surface of said second top cover flap adjacent said opposite edge.

11. The folding carton of claim 10, a liner on said adhesive, said liner being selectively removable to expose said adhesive for securing said second top cover flap to said first and third side walls.

12. The folding carton of claim 10, wherein said second top cover flap has ears extending from opposite sides of said second cover flap defining said greater width.

13. The folding carton of claim 12, wherein said second top cover flap includes a generally rectangular portion and said ears extend from opposite sides of said rectangular portion, and said ears are hingedly connected to said rectangular portion.

14. The folding carton of claim 12, wherein said adhesive is on one surface of said ears.

15. The folding carton of claim 14, wherein said adhesive comprises a continuous strip of adhesive on said ears and adjacent said opposite edge of said second top cover flap between said ears.

16. The corrugated container of claim 10, wherein said blank is cut with a perforated connection between said ears and said first and third top cover flaps.

17. The corrugated container of claim 16, further comprising punched out holes between said ears and said first and third top cover flaps.

18. The folding carton of claim 10, further comprising a tear off strip in said second top cover flap spaced from and parallel to said second top cover flap one edge and adjacent to but spaced from opposite edge portion.

* * * * *